United States Patent [19]

Kraft

[11] 4,055,976

[45] Nov. 1, 1977

[54] METHOD OF ROLLER SPINNING CUP-SHAPED METAL BLANKS AND ROLLER CONSTRUCTION THEREFOR

[75] Inventor: Derald H. Kraft, Canton, Ohio

[73] Assignee: Aspro, Inc., Canton, Ohio

[21] Appl. No.: 671,132

[22] Filed: Mar. 29, 1976

[51] Int. Cl.[2] ..... B21D 22/14

[52] U.S. Cl. ..... 72/83; 29/159 R; 72/377; 72/85

[58] Field of Search ..... 72/82, 83, 85, 377, 72/379; 29/159 R

[56] References Cited

U.S. PATENT DOCUMENTS

| | | | |
|---|---|---|---|
| 1,671,994 | 6/1928 | Nelson | 72/83 |
| 1,728,002 | 9/1929 | Nelson | 72/83 |
| 3,187,534 | 6/1965 | Kolpakcloglu | 72/83 |
| 3,282,078 | 11/1966 | Kaesmeyer | 72/82 |
| 3,823,591 | 7/1974 | Schröder | 72/85 |
| 3,991,598 | 11/1976 | Kraft | 72/83 |

*Primary Examiner*—Leon Gilden
*Attorney, Agent, or Firm*—Frease & Bishop

[57] ABSTRACT

A method of making a dynamically balanced cup-shaped blank for use in the production of a V-grooved pulley from a flat sheet metal disc by flow forming the metal with an improved metal spinning roller construction. The disc is mounted on rotating die means between headstock and tailstock die forming assemblies of a spinning machine. A first spinning roller pressure shear forms and thins an intermediate annular portion of the disc along a conical surface of the headstock die to form a conical wall of the cup-shaped blank, with an unworked outer annular portion of the disc extending outwardly of the conical wall. A plurality of the improved rollers are moved axially along and parallel with the headstock die means in a single pass. Outer curved front end surfaces of the rollers lay the outer unworked annular portion of the disc along a cylindrical surface of the headstock die form without materially reducing the metal thickness to rough form a cylindrical wall of the cup-shaped blank. This cylindrical cup wall then is immediately thinned and elongated along the cylindrical surface of the headstock die by a first metal deformation zone formed on each of the rollers. The depressed metal is permitted to expand slightly into a relief zone formed on each of the rollers immediately rearwardly of the first metal deformation zone. This expanded metal is immediately thinned further by a second metal deformation zone formed on each of the rollers. The metal then is immediately burnished and again expanded slightly outwardly to facilitate its removal from the headstock die by a second metal relief zone or burnishing surface formed on the rear of the rollers.

The improved roller has a front face and a curved surface extending rearwardly axially therefrom. A first conical surface extends rearwardly outwardly from the curved front surface forming a first metal deformation zone joined immediately integrally with the curved surface. A rearwardly inwardly extending first metal expansion zone forms a first corner at the junction with the first metal deformation zone, with the corner having a radius greater than any radius of a point of the curved front surface. A second conical surface extends rearwardly outwardly from the first expansion zone forming a second metal deformation zone. A rearwardly inwardly extending second metal expansion zone forms a second corner with the second conical surface, with the second corner having a radius measured from the axis of the roller greater than the radius of the first corner.

5 Claims, 16 Drawing Figures

METHOD OF ROLLER SPINNING CUP-SHAPED METAL BLANKS AND ROLLER CONSTRUCTION THEREFOR

BACKGROUND OF THE INVENTION

1. Field of the Invention

The invention relates to a method of roller spinning dynamically balanced cup-shaped metal stage blanks for subsequent use in spinning V-grooved pulleys by flow forming the blank metal in a series of continuous metal thinning operations with a plurality of improved rollers. The invention further relates to an improved roller construction for carrying out the steps of such a spinning method in which the roller is provided with a series of integrally joined metal deformation and expansion zones enabling large amounts of metal to be flow formed along a die form in a single roller pass.

2. Description of the Prior Art

Many procedures have been used and are known for the formation of cup-shaped metal blanks from flat sheet metal discs which blanks in turn are used in the manufacture of V-grooved pulleys, or similar articles. Many of these procedures involve stamping, drawing and slitting operations, examples of which are shown in U.S. Pat. Nos. 1,766,098, 2,330,228, 2,493,053 and 3,080,644. Cup-shaped stage blanks for V-grooved pulleys produced by such prior stamping and drawing methods are not balanced dynamically since the blanks are formed by a series of progressive die steps on a non-rotating blank.

Other procedures and apparatus have been known for directly spinning cup-shaped blanks and V-grooved pulleys from flat metal discs for producing dynamically balanced V-grooved pulleys, as shown in U.S. Pat. No. 1,728,002. The equipment and dies required, however, involves headstock dies with sliding and movable members which considerably increase the cost of pulley manufacture with such apparatus. Likewise, these dies require means on the machine for controlling movement of the die components which contribute to the increased costs and involve maintenance problems. Also, considerable tooling costs are involved to provide various dies from which to produce a variety of cup blanks, since a different die size and configuration is required for each type of cup blank produced.

Several other known procedures for spinning objects from flat sheet metal blanks are known, such as the procedure in U.S. Pat. No. 3,195,491 for spinning rounded bowl-like blanks from discs in producing tapered disc wheels. Conical-shaped metal objects are produced by roller spinning procedures in U.S. Pat. No. 3,104,640. The disc wheel or conical-shaped metal objects produced by such methods have tapered or curved side walls which are not suitable for V-grooved pulley manufacture. U.S. Pat. No. 3,282,078 uses tubular-shaped blanks instead of flat metal discs to spin grooved objects. This procedure flows the metal by thinning the sidewalls of the tubular blank to form an enlarged curved end groove.

Flow forming of metals has increased in importance in recent years in the production of many products formerly produced by stamping, extrusion drawing, etc. In the flow forming of metals, a relatively thick walled blank is placed on a rotating mandrel and is stretched and elongated to thin the metal by one or more rollers in one or more roller passes along the mandrel. The amount of metal reduction possible depends upon many factors such as the type of metal, power rating of the spinning machine, type and shape of the rollers, and number and speed of roller pases. The starting blanks may be drawn, pressed, forged and extruded, as well as open ended tubing. Preformed round sheet metal blanks also may be roller spun into a cup at the start of the roller passes and then flow formed in one and the same pass in forming the desired product.

Known roller constructions have various shapes and configurations depending upon the material to be flow formed, the degree of metal deformation and the type of blank (flat blank, pre-drawn blank, etc.) being worked. One of the common types of roller shapes has a front flow forming collar formed by a relatively long rearwardly outwardly tapered conical surface which terminates in a short rearwardly outwardly extending surface which in turn forms a single metal working corner with a rearwardly inwardly extending conical burnishing surface. Another type of roller which is used primarily for forming aluminum and other soft metals has a large radius configuration on the leading part of the roller for shaping a round blank into a cup followed by reduced diameter conical and cylindrical sections which are integrally joined with a trailing roller portion having the flow forming collar type configuration described above. Still another type of roller configuration, sometimes referred to as a conical roller, has a small rearwardly outwardly extending conical surface which forms a metal working corner with a following, rearwardly inwardly tapered conical surface.

All of these known roller constructions and methods for flow forming metal have and use only a single metal deformation or working surface. This requires multiple or slower roller passes along the rotating mandrel to achieve the desired amount of metal thinning, or requires more powerful and expensive spinning machines to achieve the desired thinning and elongation.

No known metal flow forming methods and improved roller construction for carrying out the steps of such a method to produce cup-shaped pulley blanks, of which I am aware, provides at least a pair of flow forming corners or surfaces separated by a metal relief zone on a single roller, whereby the metal is flow formed along a rotating mandrel by such a series of metal forming surfaces to provide greater movement of metal in a single pass than heretofore achieved.

SUMMARY OF THE INVENTION

Objectives of the invention include providing an improved metal flow forming roller construction having a generally rounded nose with a series of metal deformation surfaces separated by relief zones which permits the deformed metal to expand slightly thereinto, and in which the roller terminates in a conical burnishing surface to improve the surface quality and to assist in loosening the flow formed cup-shaped blank from the headstock die for removal of the blank from the die; providing such an improved roller construction which enables larger amounts of metal to be elongated and thinned in a single roller pass along a rotating headstock die by progressively simultaneously thinning the metal by the spaced metal deformation zones formed on the roller; providing a new method, procedure and series of steps for flow forming a cup-shaped metal blank for use in forming multi V-grooved pulley structures by use of a plurality of the new roller construction, in which a circular sheet metal blank disc is mounted between rotating headstock and tailstock dies with an inner annular portion of the blank disc being roller shear spun along the headstock die to form a rearwardly outwardly extending conical wall integrally connected with the hub wall of the pulley blank, and in which a plurality of the new roller constructions are diametrically spaced with respect to the spinning machine axis and are moved parallel along the headstock die to flow form an outer unworked annular portion of the disc blank along the headstock die in a series of progressively, simultaneously thinning and elongating steps whereby the metal is worked by the spaced metal deformation zones of the impoved roller construction; and providing a new roller construction and a method of making pulley blanks by use of a plurality of the improved roller which achieves the stated objectives effectively and efficiently, and which solves problems and satisfies needs existing in the pulley spinning art.

These objectives and advantages may be obtained by the new metal flow forming roller construction, the general nature of which may be stated as including a generally annular body having a longitudinal axis with the annular body including, a front roller portion having a front end face generally normal to the roller axis terminating in a surface extending in cross-section outwardly away from the end face and curving rearwardly in a generally axial direction; a first conical surface extending rearwardly outwardly from the curved front roller portion forming a first metal deformation zone joined immediately integrally with said curved surface; a first expansion zone extending rearwardly inwardly from the first deformation zone and joined with the first deformation zone by a first corner defining in cross-section an acute included angle, the first corner having a radius measured from the roller axis greater than any radius of any point of the front portion curved surface normal to the roller axis; a second conical surface extending rearwardly outwardly from the first expansion zone forming a second metal deformation zone joined integrally with said first expansion zone; and a second expansion zone extending rearwardly inwardly from the second deformation zone and joined with the second deformation zone by a second corner defining in cross-section an acute included angle, said second corner having a radius greater than the radius of the first corner.

The general nature of the new method of making a cup-shaped sheet metal blank of the type having a circular bottom hub flange wall and an outwardly extending conical wall terminating in an integrally connected outer cylindrical side wall having an open end from a flat sheet metal disc blank with pressure roller forming means for use as a stage blank for forming a V-grooved pulley, may be stated as including the steps of providing a flat sheet metal disc blank having a central hole formed therein; clamping a central portion of the disc around the hole between opposed relatively axially movable complementary clamping faces of rotatable first headstock die means wherein the first headstock die means also has conical flange forming means extending outwardly of the clamping face and terminating in cylindrical flange forming means; rotating the first die means and clamped disc; forming the outwardly extending conical wall of the stage blank by pressure rolling, forming and ironing an intermediate annular portion of the rotating disc surrounding the central portion by first roller means against the headstock die means conical flange forming means, with a remaining outer unworked annular disc portion extending outwardly from the formed conical wall; laying the outer unworked annular portion of the blank disc along the cylindrical flange forming means of the headstock die means by second roller means without appreciably affecting the metal thickness, by pressure rolling said outer annular portion against said cylindrical flange forming means in rough forming the cylindrical side wall of the cup-shaped blank; immediately thinning and elongating the metal of the rough formed cylindrical side wall by the second roller means progressively simultaneously with the rough forming of said side wall by pressure roller flow forming the metal along the cylindrical flange forming means of the headstock die means; permitting the thinned and elongated flow formed metal to expand outwardly immediately after being thinned and elongated with the amount of expansion being less than the amount of thinning; and immediately further thinning and elongating the expanded metal by the second roller means progressively simultaneously with the rough forming and initial thinning and elongating of the metal by pressure roller flow forming the metal further along the headstock die means to form the cylindrical wall of the cup-shaped blank.

BRIEF DESCRIPTION OF THE DRAWINGS

Preferred method steps of the invention, and the construction of the improved roller for use in carrying out the steps of the new procedure - illustrative of the best mode in which applicant has contemplated applying the principles - are set forth in the following description and shown in the accompanying drawings, and are particularly and distinctly pointed out and set forth in the appended claims.

Similar numerals refer to similar parts throughout the drawings.

DESCRIPTION OF THE PREFERRED EMBODIMENT

Figure 1:
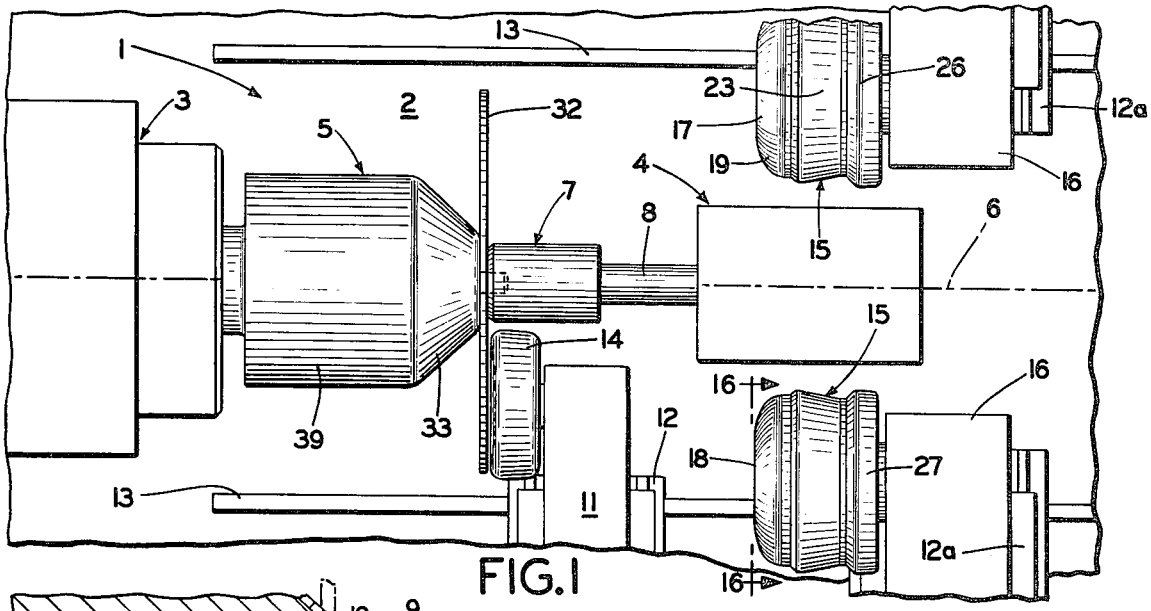
FIG. 1 is a fragmentary diagrammatic top plan view of portions of a type of simple spinning machine which may be used to carry out certain steps of the new procedure.

A portion of a typical simple lathe-type spinning machine for carrying out the steps of the improved roller forming method is shown in FIG. 1 and is indicated generally at 1. Spinner 1 includes a bed 2, a headstock assembly 3 and a tailstock assembly 4. A headstock die form 5 is mounted on headstock assembly 3 and is rotated by a motor driven shaft (not shown).

Figure 2:
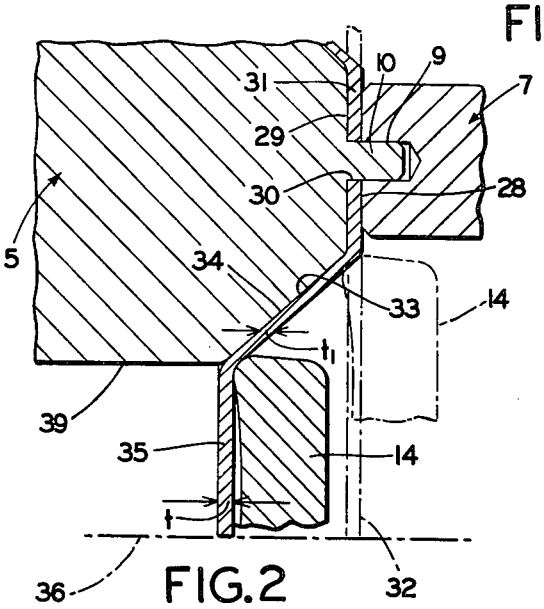
FIG. 2 is a somewhat diagrammatic fragmentary sectional view of a flat sheet metal disc shown in dot-dash lines, mounted between headstock and tailstock dies of the spinning machine shown in FIG. 1, and showing the spinning of a rearwardly outwardly extending thinned conical wall of a cup-shaped pulley stage blank produced by the improved procedure.

Tailstock assembly 4 preferably has a die form 7, axially movable by a piston rod 8. An aperture 9 is formed in tailstock die 7 for receiving a pilot pin 10 formed on and extending axially outwardly from the center of the headstock die 5 (FIG. 2).

A tool holder 11 is movably mounted on a cross-feed carriage 12 which in turn is movably mounted on a pair of guide rods 13 (only one of which is shown in FIG. 1) for longitudinal axial movement between headstock 3 and tailstock 4. A first pressure spinning roller 14 is rotatably mounted on tool holder 11 and is movable in both parallel and transverse directions with respect to the longitudinal axis 6 of spinning machine 1 by manipulation along cross-feed carriage 12 and guide rods 13.

The particular construction and arrangement of machine 1 and the components thereof, may be modified and changed without affecting the concept of the invention. The important feature brought out by the construction of machine 1 shown in FIG. 1 is the relative simplicity thereof in contrast with the known complex prior art spinning machines used for a variety of spinning procedures.

In accordance with the invention, a pair of second rollers indicated generally at 15, are rotatably mounted on tool holders 16, which in turn are movably mounted on cross-feed carriages 12*a* and on guide rods 13 for transverse and axial movement, respectively, with respect to headstock 3 and tailstock 4. Each of the improved rollers 15 is provided with a front rounded nose 17 having an end face 18 (FIGS. 4, 5, 6 and 16) which is formed integrally with a rearwardly extending gradually curved surface 19 which terminates in a generally axially extending portion 20. End faces 18 are generally normal to roller axes 21 (FIG. 6) with curved surfaces 19 having relatively large radii of curvatures with respect to the other metal working surfaces of rollers 15 described below.

A relatively small conical surface 22 is joined integrally with axially extending portion of curved surface 19 and extends rearwardly outwardly therefrom and forms a first metal deformation zone. Another conical surface 23, considerably longer in axial length than surface 22, extends rearwardly inwardly from conical surface 22. Surface 23 forms a corner 24, having an acute angle in cross section (FIG. 6) at the junction with metal deformation surface 22. Corner 24 has a radius R which is greater than the radius of any point of curved surface 19 and axial portion 20, as indicated by $R_1$, when taken normal to roller axis 21. Concial surface 23 forms a first metal expansion zone or pressure relief zone, the purpose of which is discussed below.

Figure 6:
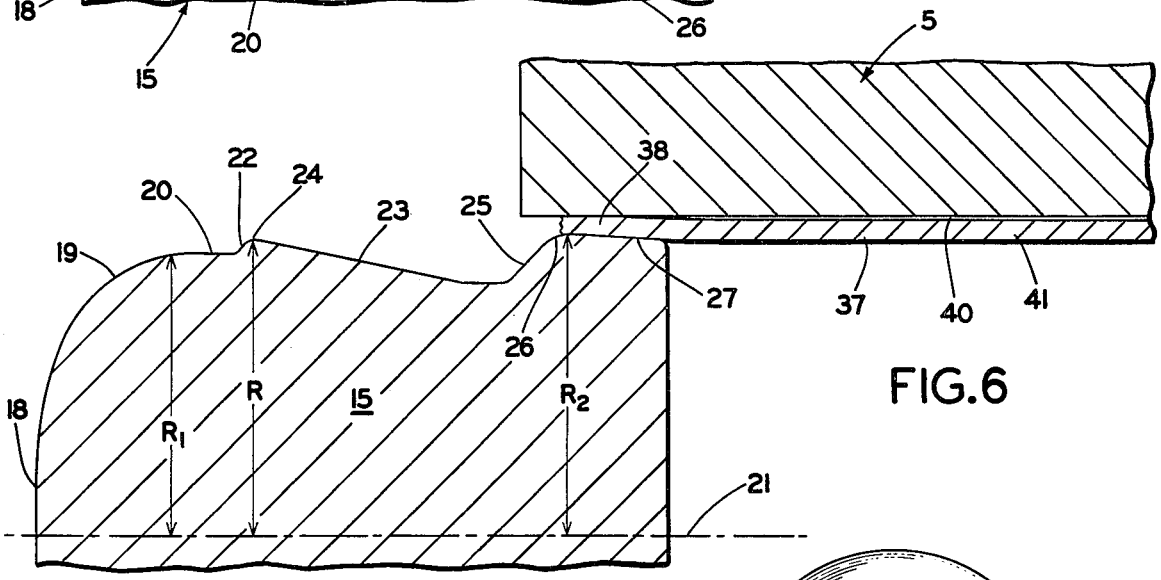
FIG. 6 is a greatly enlarged fragmentary sectional view similar to FIGS. 4 and 5, with the improved roller being shown in section, showing completion of the thinning of the metal, and the subsequent burnishing of the cup-shaped blank cylindrical wall.
Figure 16:
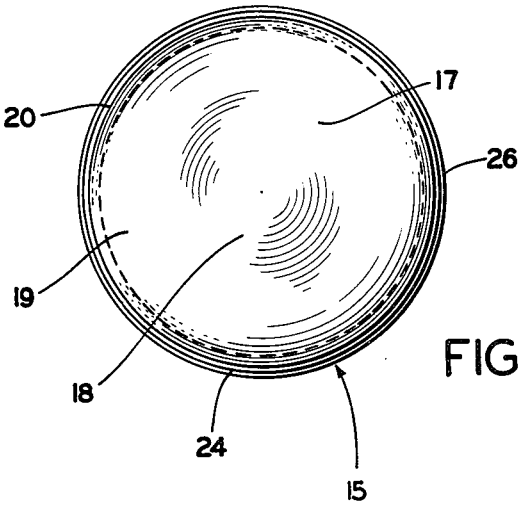
FIG. 16 is an enlarged front end view of one of the improved roller constructions shown particularly in FIGS. 3–6 for forming and thinning the cylindrical cup-shaped blank wall portion, looking in the direction of arrows 16—16, FIG. 1.

A second metal deformation zone is formed by a second rearwardly outwardly extending conical surface 25 which is formed integrally with the rear of inwardly extending conical surface 23. Surface 25 forms a second corner 26 at the junction with a second rearwardly inwardly extending conical surface 27. Corner 26 has a radius $R_2$ (FIG. 6) which is larger than radius R of corner 24. Corners 24 and 26 preferably are somewhat rounded in cross section as shown in FIG. 6.

The improved roller spinning procedure is set forth diagrammatically in FIGS. 2–6. A flat sheet metal disc blank 32 shown in full lines in FIG. 1 and in dot-dash lines in FIG. 2, is clamped between a circular end face 28 of tailstock die 7 and a larger circular flat face 29 of headstock die form 5 by actuation of a hydraulic cylinder or the like controlling piston rod 8. Pilot pin 10 projects through a central hole 30 formed in disc 32 and into aperture 9 of tailstock die 7 to properly align and center disc 32 on headstock die form 5 of spinning machine 1.

The first forming roller 14 is guided into contact with a central annular portion of rotating blank disc 32 as shown in dot-dash lines, FIG. 2, by the concurrent movement of cross carriage 12 and tool holder 11 until pressure is exerted on disc 32. Carriage 12 then moves longitudinally along guide rods 13 forwardly towards headstock die 5 simultaneously with the radially outward movement of tool holder 11 causing roller 14 to follow a general diagonal path as shown in FIG. 2, from the dot-dash line position to the full line position thereof. Roller 14 shear forms, irons, and thins an intermediate annular portion of disc 32 against a conical surface 33 of headstock die form 5 to form a thinned conical wall portion 34 of stage blank 24. The central portion of disc 32 which is clamped against end face 29 of die 5, forms a flat bottom hub wall which is integral with conical wall 34.

The outermost annular portion 35 of disc blank 32 (FIG. 2) remains unworked and retains the original disc blank metal thickness "*t*". Shear formed thinned conical wall portion 34 has an axial thickness "$t_1$" equal to the original disc thickness "*t*", with annular disc portion 35 extending radially outwardly to the original diameter of blank disc 32, as indicated by imaginary line 36.

Figure 3:
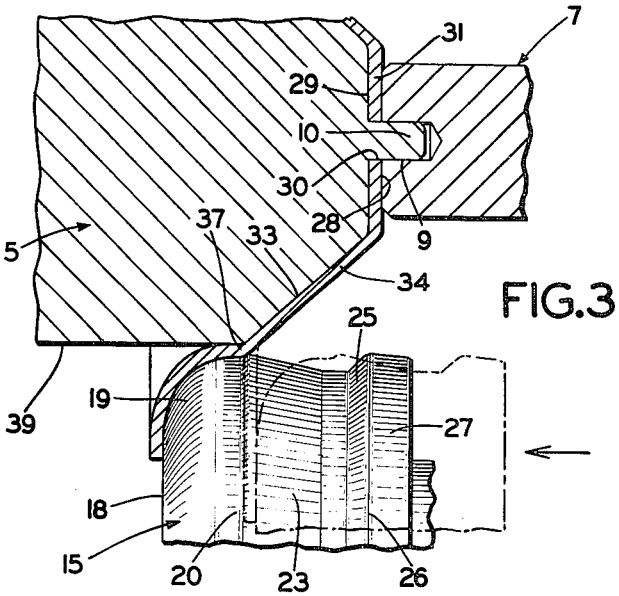
FIG. 3 is a view similar to FIG. 2 showing a step of the improved roller spinning operation in which an annular end portion of the blank disc is being laid along the headstock die form by a curved outer front end surface of one roller of a pair of the improved roller construction which are moved parallel with and along the axis of the headstock die in a single pass.

In accordance with the invention, improved rollers 15 move in unison longitudinally along and parallel with spinning machine axis 6 toward headstock die 5. End face 18 initially contacts unworked annular disc portion 35 and together with curved surface 19 and axial surface portion 20, lays the metal of disc portion 35 along a cylindrical side wall forming surface 39 of headstock die 5 (FIG. 3). Rollers 15 are set a predetermined radial distance from spinning machine axis 6, depending upon the metal thickness of blank disc 32, so that surfaces 19 and 20 do not appreciably thin the metal as it is layed along die wall 39.

Figure 4:
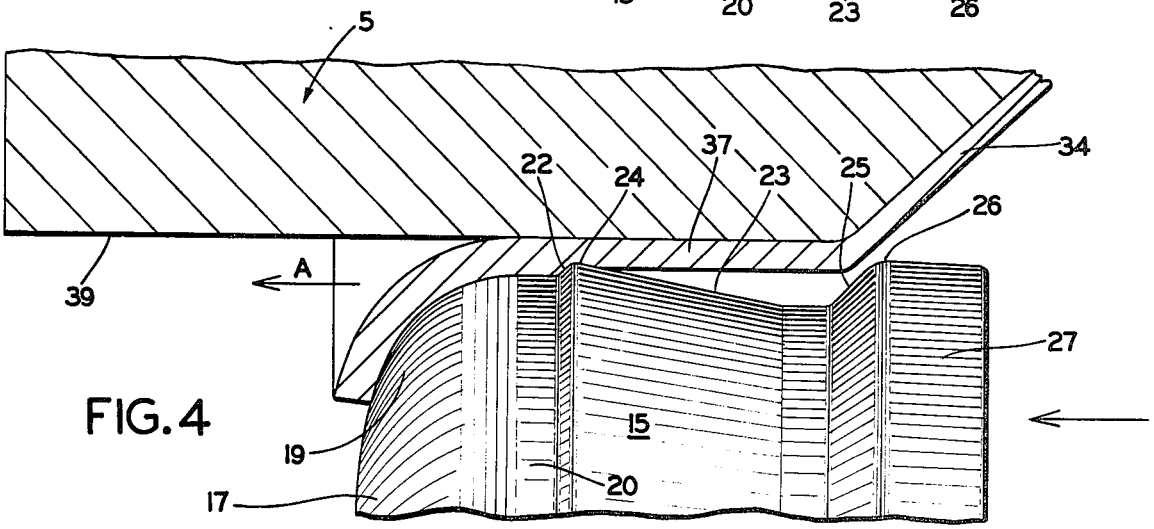
FIG. 4 is a greatly enlarged sectional view similar to FIG. 3 showing the step of generally simultaneously thinning the metal immediately as it is being laid along the headstock die form and permitting the thinned metal to immediately expand slightly outwardly after its deformation.

Immediately upon laying of the disc metal along sidewall 39, the metal is thinned by conical surface 22 of the first metal deformation zone (FIG. 4). Surface 22 flows forms and elongates the metal rearwardly in the direction of arrow A, along headstock die wall 39 progressively simultaneously with the laying of the metal by rounded nose 17.

The thinned metal, which is under considerable pressure by surface 22 and corner 24, is permitted to expand immediately into the first expansion zone formed by conical surface 23 (FIG. 4) as each roller 15 continues to advance along the headstock die. The amount of expansion of the just thinned and flow formed metal is very slight and is less than the amount of thinning accomplished by surface 22 and corner 24.

Figure 5:
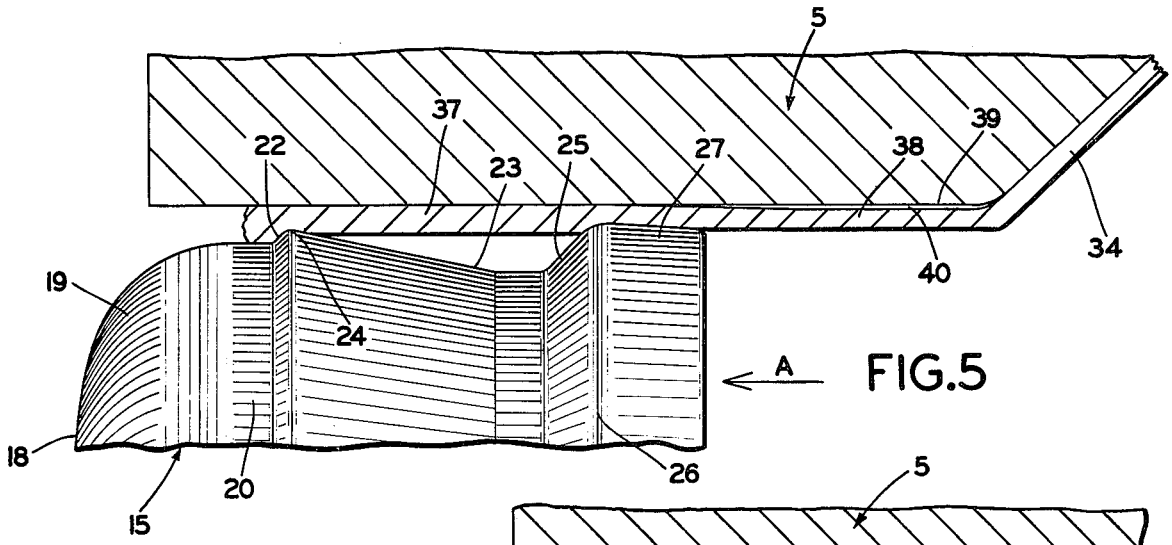
FIG. 5 is a greatly enlarged fragmentary sectional view similar to FIG. 4 showing the step of simultaneously progressively thinning the metal by a second deformation zone at the rear of the improved roller as the roller moves along the headstock die form.

Rollers 15 continue to advance toward headstock die 5 parallel with and along cylindrical side wall surface 39 from the position of FIG. 4 to the position of FIG. 5. The second metal deformation zone formed by conical surface 25 engages the thinned and slightly expanded metal indicated at 37, at the junction of conical wall 34 (FIG. 4) and further thins and elongates the metal in the direction of arrow A along die side wall 39. This subsequent thinning occurs generally simultaneously with the initial thinning of the metal by surface 22 and corner 24 located axially rearwardly along the rough formed cylindrical cup side wall (FIG. 5). The initially thinned and slightly expanded metal 37 is further thinned an amount approximately equal to the difference between diameters $R_2$ and R of corners 24 and 26.

Rearmost conical surface 27 of roller 15 preferably extends at an angle of approximately 1° with respect to a line parallel with roller axis 21. Surface 27 continues to work metal 38 causing the metal to expand outwardly from headstock die 5 as shown by an exaggerated space 40 between side wall metal 38 and die surface 39 in FIG. 5. This working by roller surface 27, which also may be referred to as a burnishing surface, improves the surface quality of the final thinned metal 38, in addition to its desirable expanding effect. The expanding effect of roller surface 27 enables the cup-shaped stage blank produced to be ejected easily off of die 5. Without such secondary working and expanding, the stage blank may be pressed tightly against the die requiring excessive ejection forces.

Figure 7:
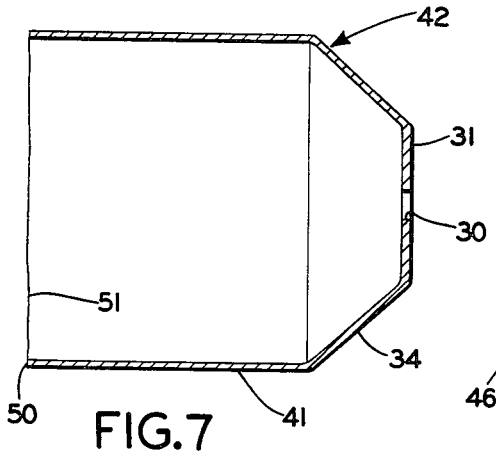
FIG. 7 is a reduced sectional view of a dynamically balanced roller spun, cup-shaped metal stage blank having a thinned cylindrical wall portion which is produced by the roller spinning steps shown in FIGS. 1–6.

Rollers 15 continue to advance to the position of FIG. 6, completely elongating and thinning the metal portion 37 into the final worked burnished metal portion 38, forming cylindrical cup side wall 41 of the cup-shaped pulley stage blank 42 (FIG. 7), produced by the improved spinning method and steps of FIGS. 1–6.

The thinning, elongation and burnishing of the outer annular disc portion 35 to form cylindrical wall 41 of stage blank 42 by the continuous axial straight line movement of the uniquely shaped, spaced rollers 15 is one of the important features of the improved spinning method. The particular configuration and shape of rollers 15, provide a series of spaced worked metal flow forming surfaces and corners 22–24 and 25–26 of increasing diameters which eliminates complicated and time consuming spinning procedures of multiple passes of the spinning tool in order to achieve a greater amount of metal movement heretofore required in known prior flow forming metal procedures.

The relatively large radius of curvature of roller forming surface 19 enables disc portion 35 to be laid along die surface 39 easily and with a minimum of force, reducing the heating and excess stressing of the metal, which reduces the formation of weak spots in the finished spun pulley.

Figure 8:
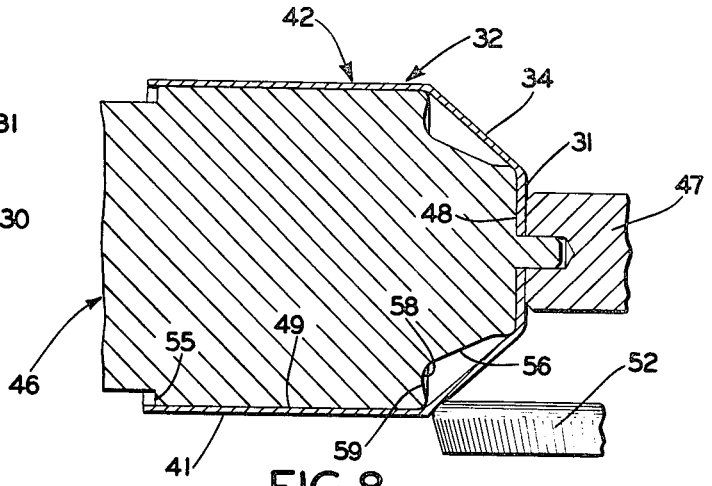
FIG. 8 is a generally diagrammatic, fragmentary sectional view showing the stage blank of FIG. 7 being clamped by a tailstock die on a second headstock die form preparatory to forming a reentrant conical pulley groove flange therein.

The dynamically balanced cup-shaped blank 42 then may be removed either manually or automatically from die form 5 of spinning machine 1 and placed on a second cup forming headstock die 46 (FIG. 8), which preferably is mounted on a second or different spinning machine. Pulley blank 42 is mounted on die 46 by a tailtock die form 47 which clamps hub wall portion 31 against a complementary circular end face 48 of the die, with cylindrical wall 41 being in generally sliding engagement with complementary cylindrical die side wall surface 49.

The next series of operations or steps shown in FIGS. 8–13, form no part of the method of the invention but are illustrative of a type of procedure for forming a multi V-grooved pulley from the stage blank 42 produced by the improved method of FIGS. 1–6. A single roller 52 is moved along a carriage and cross-feed mechanisms (not shown) similar to mechanism 11 and 12, to the position of FIG. 8. Roller 52 then moves in a series of passes with respct to headstock die 46 from the position of FIG. 8 to the positions of FIGS. 9 and 10.

Figure 10:
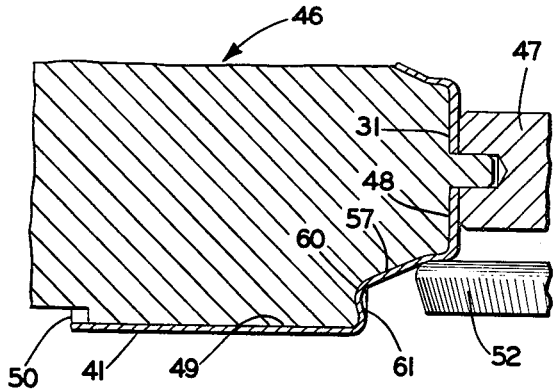
FIG. 10 is a view similar to FIGS. 8 and 9, showing the step of completing the formation of the reentrant flange and conical hub wall in the cup-shaped stage blank.
Figure 9:
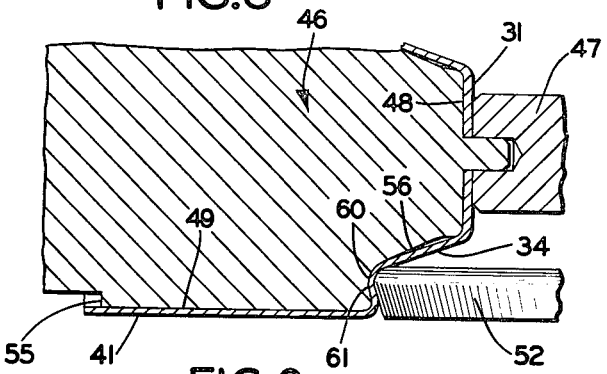
FIG. 9 is a view similar to view 8, showing the start of forming the reentrant pulley groove flange in the intermediate stage blank.
Figure 12:
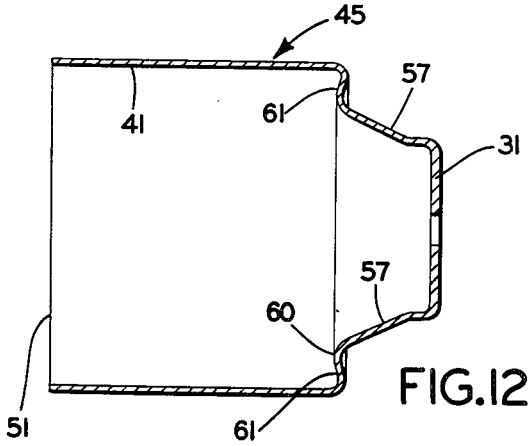
FIG. 12 is a sectional view of a dynamically balanced roller spun, cup-shaped metal pulley stage blank formed from the flat metal disc by the roller spinning step shown in FIGS. 1–11.

Roller 52 forms and irons the metal of conical wall 34 of stage blank 42 along and against a conical wall 56 of die form 46 to form a conical wall section 57 integrally connected to hub wall portion 31 and flairs outwardly with respect thereto (FIG. 10). Subsequent to forming conical wall section 57, roller 52 forms, irons and presses the outer portion of the metal of conical wall 34 into an acutely angled corner 58 formed in die form 46, which connects conical die wall 56 with a reentrant conical flange forming die wall 59. This working forms a complementary acute angled corner 60 and a conical reentrant flange 61 in conical wall 34 of stage blank 42, with corner 60 integrally connecting conical wall section 57 with reentrant flange 61.

Figure 11:
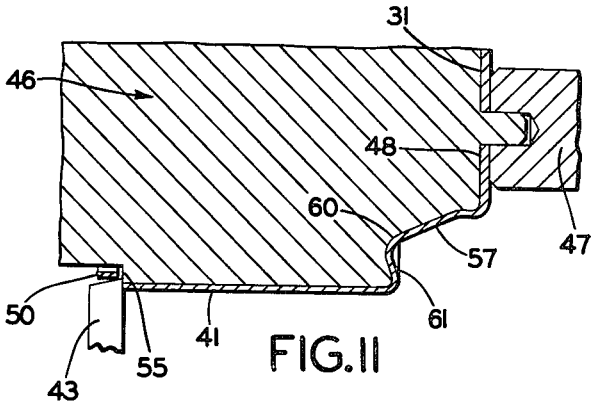
FIG. 11 is a view similar to FIGS. 8–10, showing a trimming operation being performed on the open end of the cup-shaped metal stage blank.

The extended, somewhat irregular, end 50 of side wall 41 which forms the cup end opening 51 of pulley blank 42 then is trimmed to a predetermined axial length by moving a trimming wheel 43 of the type shown in U.S. Pat. No. 2,702,597 inwardly on a cross-feed carriage (FIG. 11). Die 46 preferably has an annular shoulder 55 formed adjacent the end of cylindrical die wall 49 to cooperate with trimming wheel 43 to prevent scoring of the die and dulling a wheel 43 upon trimming end portion 50 from the modified cup-shaped pulley blank 45 shown particularly in FIG. 12.

Figure 13:
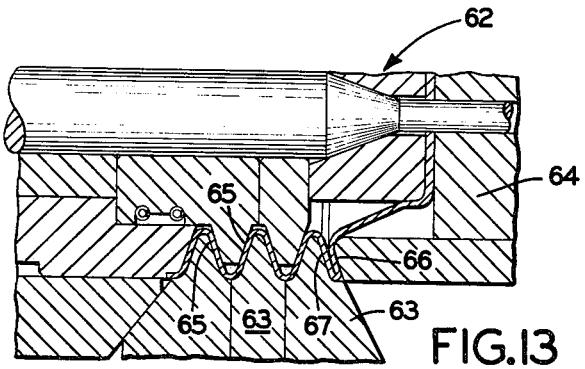
FIG. 13 is a fragmentary, generally diagrammatic sectional view showing the formation of a plurality of V-grooves in the cylindrical side wall of the cup-shaped metal stage blank of FIG. 12.

Modified stage blank 45 then may be removed either manually or automatically from die 46 of the second spinning machine andplaced on a pulley forming headstock die assembly 62, only a portion of which is shown in FIG. 13, which preferably is mounted on a third spinning machine.

Figure 15:
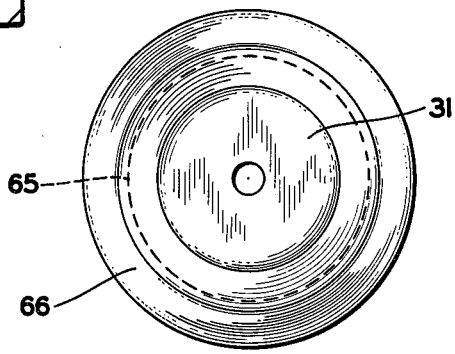
FIG. 15 is an end elevation of the completed multi V-grooved pulley looking in the direction of arrows 15—15, FIG. 14.
Figure 14:
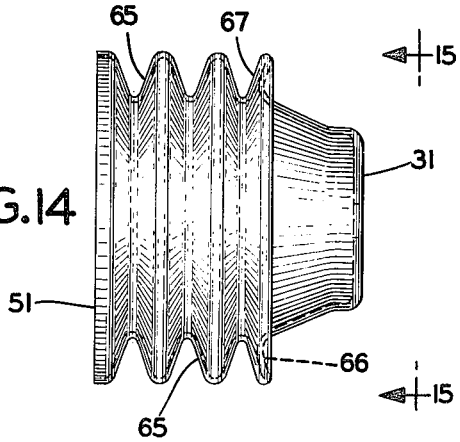
FIG. 14 is an elevational side view showing a completed multi V-grooved pulley formed from the cup-shaped stage blank of FIG. 12.

A plurality of rough and finishing pulley groove forming rolls 63 of the type shown in U.S. Pat. Nos. 2,869,223 and 3,852,863 are moved transversely radially inwardly engaging cylindrical wall 41 of pulley blank 45. Rolls 63, in combination with the axial movement of a tailstock die assembly 64, forms multiple V-grooves 65 in blank wall 41. Reentrant flange 61 forms a double thickness flange wall 66 with a matching second flange portion 67, formed from a portion of the metal of cylindrical wall 41. The remaining V-grooves are formed by single thickness flange walls from the metal of cylindrical wall 41. A type of finished multi V-grooved pulley, produced by the above described steps and procedures, is shown in FIGS. 14 and 15.

Fundamental facets of the new concept involve the procedure for the spinning operations and manufacture of a dynamically balanced cup-shaped pulley blank with the cylindrical wall of the pulley blank being formed by a plurality of an improved roller construction which are moved in a single pass along the headstock die and parallel with a cylindrical flange forming wall formed on the headstock die. An extended unworked end portion of the blank disc is laid along the cylindrical die wall by the rounded front nose portion of the improved rollers immediately followed by the elongation and thinning of the just laid metal by a series of metal deformation surfaces which are separated by metal expansion or relief zones formed on the roller. The thinned and elongated metal is burnished and expanded outwardly away from the cylindrical die all by a burnishing surface on the end of the rollers to improve the surface quality of the metal and to facilitate the removal of the blank from the headstock die. The improved method and roller construction further enables relatively large amounts of metal to be moved along a headstock die in a single pass by a plurality of the improved rollers.

The spinning machines used for carrying out the steps of the improved method are relatively simple and of an inexpensive construction and preferably will be controlled and programmed by pneumatic, hydraulic and electronic components and devices well known in the spinning art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the featues, discoveries and principles of the invention, the particular new combination of structural features of the new metal flow forming roller construction, the related procedural steps by which the cup-shaped pulley blank may be made and the advantageous, new and useful results obtained; the new and useful structures, devices, elements, arrangements, procedures, methods and steps in the manufacture of the cup-shaped pulley blank are set forth in the appended claims.

I claim:

1. In a method of making a cup-shaped sheet metal blank of the type having a circular bottom hub flange wall and an outwardly extending conical wall terminating in an integrally connected outer cylindrical side wall having an open end from a flat sheet metal disc blank with pressure roller forming means for use as a stage blank for forming a V-grooved pulley, including the steps of:

a. providing a flat sheet metal disc blank having a central hole formed therein;

b. clamping a central portion of the disc around the hole between opposed relatively axially movable complementary clamping faces of rotatable first headstock die means wherein the first headstock die means also has conical flange forming means extending outwardly of the clamping face and terminating in cylindrical flange forming means;

c. rotating the first die means and clamped disc;

d. forming the outwardly extending conical stage blank wall by pressure rolling, forming and ironing an intermediate annular portion of the rotating disc surrounding the central portion by first roller means reacting against the headstock die means conical flange forming means, while leaving unworked an annular disc portion extending outwardly from the formed conical wall;

e. laying the outer unworked annular portion of the blank disc along the cylindrical flange forming means of the headstock die means by pressure rolling with second roller means said outer annular portion against said cylindrical flange forming means to rough form a cylindrical side wall of a cup-shaped blank, while maintaining the annular portion metal thickness as said outer annular portion metal is being laid to re shaped cylindrical form;

f. thinning and elongating the metal of the rough formed cylindrical side wall progressively simultaneously immediately after the rough forming of said side wall by pressure rolling flow forming the metal with said second roller meams rearwardly along the cylindrical flange florming means of the headstock die means;

g. permitting the thinned and elongated flow formed metal to expand outwardly an amount less than the amount of thinning immediately after being thinned and elongated; and h. further thinning and elongating the expanded metal pogressively simultaneously immediately after the expansion of the initial thinning and elongating of the metal by pressure rolling flow forming the metal with said second roller means further along the headstock die means.

2. The method set forth in claim 1 including the additional step of permitting the further thinned and elongated metal of the formed cylindrical wall to expand outwardly from the cylindrical flange forming means of the headstock die means by roller engaging the metal with a conical end surface of the second roller means progressively simultaneously immediately after the final thinning and elongating of the cylindrical wall metal.

3. The method set forth in claim 2 including the further step of burnishing the metal surface of the expanded thinned and elongated metal during the expansion of the further thinned and elongated metal away from the cylindrical flange forming means.

4. The method set forth in claim 1 including the further step of shear spin thinning the metal of the conical wall by the first roller means, it the metal thickness of said conical wall measured in an axial direction being generally equal to the metal thickness of the starting disc blank, during the forming of the conical wall of the stage blank.

5. The method set forth in claim 1 including the step of maintaining the outer unworked annular disc portion in a generally radially outwardly direction, a distance generally equal to the radius of the original sheet metal disc blank, after forming the concial wall of the stage blank and prior to the working of said unworked annular portion.

* * * * *

UNITED STATES PATENT AND TRADEMARK OFFICE

CERTIFICATE OF CORRECTION

PATENT NO. : 4,055,976

DATED : November 1, 1977

INVENTOR(S) : Derald H. Kraft

It is certified that error appears in the above-identified patent and that said Letters Patent are hereby corrected as shown below:

Column 6, line 21, add -20- between "portion" and "of"

Column 7, line 24, change "flows" to -flow-

Column 8, line 29, change "tailtock" to -tailstock-

Column 8, line 43, change "respct" to -respect-

Column 9, line 38, change "all" to -wall-

Column 9, line 61, change "featues," to -features,-

Column 10, line 38, change "re shaped" to -reshaped-

Column 10, line 44, change "meams" to -means-

Column 10, line 45, change "florming" to -forming-

Column 10, line 52, change "pogressively" to -progressively-

Column 11, line 5, change "it" to -with-

Column 12, line 7, change "concial" to -conical-

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*